US011642759B1

(12) United States Patent
Joyce

(10) Patent No.: US 11,642,759 B1
(45) Date of Patent: May 9, 2023

(54) WORKPIECE CLAMP ASSEMBLY FOR MACHINING AND CUTTING

(71) Applicant: Stephen Jude Joyce, Rome, PA (US)

(72) Inventor: Stephen Jude Joyce, Rome, PA (US)

( * ) Notice: Subject to any disclaimer, the term of this patent is extended or adjusted under 35 U.S.C. 154(b) by 15 days.

(21) Appl. No.: 17/517,295

(22) Filed: Nov. 2, 2021

(51) Int. Cl.
*B25B 5/10* (2006.01)
*B25B 5/16* (2006.01)
*B25B 5/14* (2006.01)

(52) U.S. Cl.
CPC ..... *B25B 5/109* (2013.01); *B25B 5/163* (2013.01); *B25B 5/14* (2013.01)

(58) Field of Classification Search
CPC ..... B25B 1/2405; B25B 1/2426; B25B 1/2468; B25B 5/00; B25B 5/04; B25B 5/067; B25B 5/14; B25B 5/109; B25B 5/163
USPC ..... 269/71, 73, 219, 228, 281
See application file for complete search history.

(56) References Cited

U.S. PATENT DOCUMENTS 2,932,995 A 4/1960 Durfee
3,105,330 A 10/1963 Grage
3,218,059 A 11/1965 Andrew
3,982,739 A 9/1976 Maes
3,982,740 A 9/1976 Gutman
4,340,211 A 7/1982 Chiappetti
4,772,000 A * 9/1988 Aubert ..... B25B 5/06 269/254 CS
6,158,728 A * 12/2000 Smith ..... B25B 5/006 269/93
6,247,690 B1 6/2001 Wofl
6,406,229 B1 * 6/2002 Derrick ..... B25B 5/109 409/219
2015/0091232 A1 * 4/2015 Meagher, Jr. ..... B25B 5/163 269/274

* cited by examiner

*Primary Examiner* — Lee D Wilson
*Assistant Examiner* — Alberto Saenz
(74) *Attorney, Agent, or Firm* — Gordon & Jacobson, P.C.

(57) ABSTRACT

A universal clamp assembly includes an elongate tubular base, a clamp arm adjustably secured to the tubular base at a threaded connection and an adjustment screw that adjusts the angle of the clamp arm relative to an upper surface of the base. Various workpieces can be secured between the clamping arm and the base. An optional clamping block is provided for cooperating with the clamping arm to secure cylindrical workpieces therebetween. In addition, workpieces can be inserted through the tubular base and secured.

20 Claims, 3 Drawing Sheets

WORKPIECE CLAMP ASSEMBLY FOR MACHINING AND CUTTING

BACKGROUND OF THE INVENTION

1. Field of the Invention

The present invention relates to clamp assembly. More particularly, the present invention is generally directed to a clamp assembly for holding work pieces of varying shapes and sizes for cutting, milling, drilling, tapping, boring, or other purposes in a fabrication environment.

2. State of the Art

In the manufacturing field, there are times when small or irregularly shaped parts are difficult to hold during fabrication. Conventionally, part specific specialized fixtures need to be produced in order to hold workpieces.

For example, U.S. Pat. No. 3,105,330 to Grage discloses a large solid block fixture adapted to hold flat-sided stock for grinders.

U.S. Pat. No. 3,982,739 to Maes discloses a portable vise which can clamp sections of pipe, structural tubing, or solid bar.

U.S. Pat. No. 3,982,740 to Gutman discloses a clamp device used in conjunction with an existing vice, which maintains a workpiece in fixed relationship with the vice.

U.S. Pat. No. 4,340,211 to Chiappetti discloses an adjustable V-block clamping devise that is intended to hold longer workpieces exclusively and is not conducive to holding small work pieces in varying positions.

U.S. Pat. No. 6,158,728 to Smith discloses a fixture with a clamping arm and a block for holding a workpiece. The block is specifically adapted for being received in a T-slot of a machine table. The fixture has limited application on machine tables that do not have T-slots.

U.S. Pat. No. 6,247,690 to Wolf discloses a V-block style clamping tool capable of securing small workpieces to be held for precision fabrication.

However, none of the references cited above provide a means of holding irregularly shaped parts of varying lengths, widths, and thicknesses. In addition, the prior art designs tend to be adapted for limited applications, for example, a particular machining operation or type of machine table. Additionally, all of the prior art reference designs can be limited in their portability.

Thus, due to the associated time, expense, and practicality, unique fixtures for each part instance may not be prudent for limited production quantities. In addition, fixtures with universal, multi-workpiece size, or multi-situation adaptability may be considered less cost prohibitive.

SUMMARY OF THE INVENTION

In accord with an aspect of the invention, a universal clamp assembly is provided. A universal clamp assembly includes an elongate tubular base, a clamp arm adjustably secured to the tubular base at a threaded connection and an adjustment screw that adjusts the angle of the clamp arm relative to an upper surface of the base. In an embodiment, the clamp assembly includes the components of an elongate tubular base, a nut plate optionally integrated with the tubular base, a clamp arm adjustably mounted to the tubular base with a fastener assembly, preferably including a threaded shaft, a nut, and a washer, and an adjustment screw for adjusting the angle of the clamp arm relative to an upper surface of the base.

The tubular base defines a longitudinal hollow, and a proximal end and a distal end. The distal end is preferably tapered with angled or rounded corners. The base has two longitudinally offset apertures in its upper surface.

The nut plate, when provided, is a generally rectangular bar stock sized to inserted into the hollow of the base and seats against an upper inside surface of the base. The nut plate includes a preferably flat upper surface, a distal end, a proximal end, and first and second threaded openings. The nut plate is integrated with the base.

The clamp arm is the element by which a clamping force is imparted to the workpiece. The clamping arm has a flat upper surface and a lower surface with a longitudinal channel extending from a distal end and proximally back, e.g., to a midportion. The channel is preferably in the form of a V-notch. The distal end may be tapered with angled or rounded corners. The clamp arm includes two openings: an unthreaded slot and a round threaded hole.

The adjustment screw includes a head and a shaft. The head preferably includes a knurled exterior and a hex head opening. The shaft includes machines screw threads and an end.

The unthreaded base apertures and the threaded nut-plate openings are aligned along two vertical axes. The unthreaded slot of the clamp arm is aligned with the distal one of the vertical axes.

A first end of the threaded shaft is inserted through the elongate slot of the clamp arm, through one of the apertures in the base and is threaded into one of the threaded openings of the nut plate. Depending on the size of the workpiece, the threaded shaft can be inserted into the distal or proximal aperture and threaded opening. The washer and nut are provided onto the second end of the threaded shaft.

The shaft of the adjustment screw is threadedly engaged with the second opening of the clamp arm and advanced until the end seats on the upper surface of the base.

Adjustment of the nut enlarges or decreases the distance between the clamp arm and the base to stably clamp a workpiece therebetween. The clamp arm can be moved proximally or distally along the base to facilitate securing a workpiece of various sizes. The adjustment screw is adjustable to hold the clamp arm such that the clamping and base surfaces are in a position relative to each other, e.g., parallel or optionally angled. The distal rounded corners on the base and clamp arm permit working a workpiece at such locations without interference from the clamp assembly.

In an optional aspect of the clamp assembly, a supplementary clamping block can be secured to the upper surface of the base to facilitate handling and securing of workpieces having elongate cylindrical components. The supplementary clamping block has a first surface which contacts an upper surface of the base, and a second surface provided with a V-groove which faces the opposing channel in the clamping arm. Alternatively, the supplementary clamping block can be received at the interior of the base and be used to secure a workpiece between the V-groove and the nut plate or another interior surface of the base.

The proximal end of the base can be secured in standard clamps of numerous machines, including chop saws, band saws, grinders, drill presses, etc., while the workpiece is cut, machined, or otherwise shaped. In view of the above, it is appreciated that the clamp assembly permits stably holding a variety of workpieces for shaping processes.

DETAILED DESCRIPTION OF THE PREFERRED EMBODIMENTS

Figure 1:
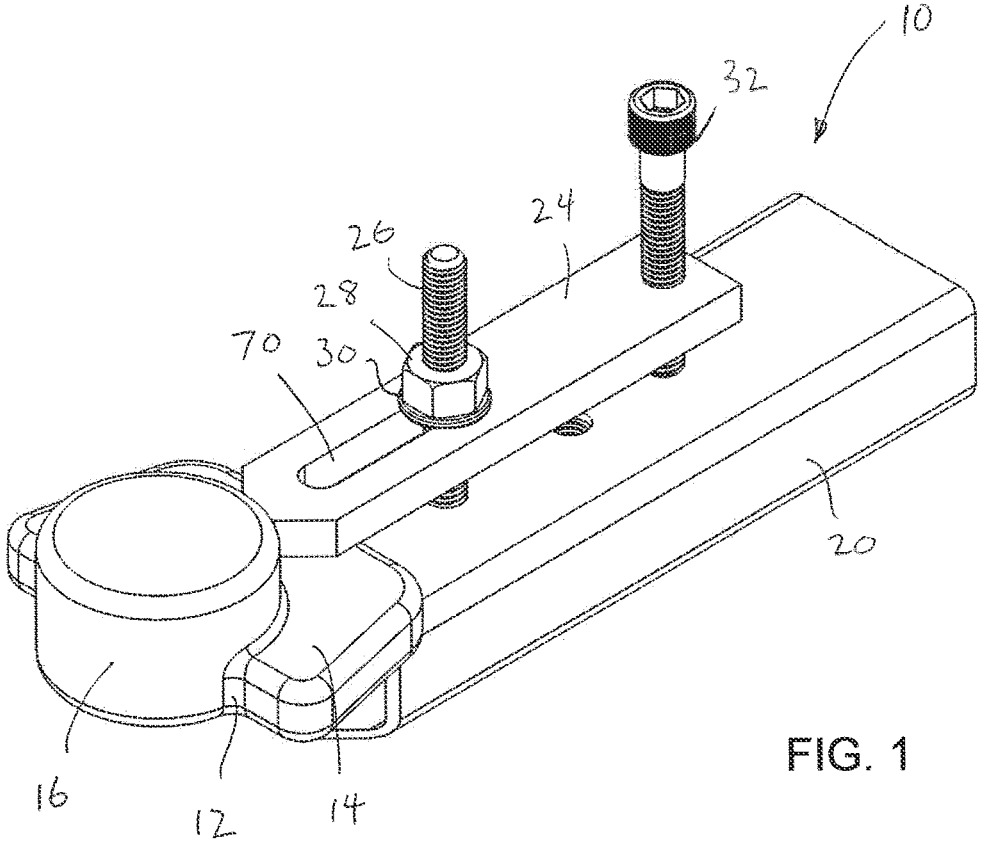
FIG. 1 is a perspective view of a universal clamp assembly according to an embodiment of the invention, in a first configuration, and shown securing a thin portion of a workpiece.

Referring to FIG. 1, a universal clamp assembly 10 is shown securing a workpiece 12. The exemplar workpiece 12 has a thinner plate portion 14, and a thicker cylindrical portion 16, but the workpiece can have any of variety of shapes and sizes, and the shape thereof is not an aspect of the invention but rather merely representative of a workpiece suitable for use in the clamp assembly.

Figure 2:
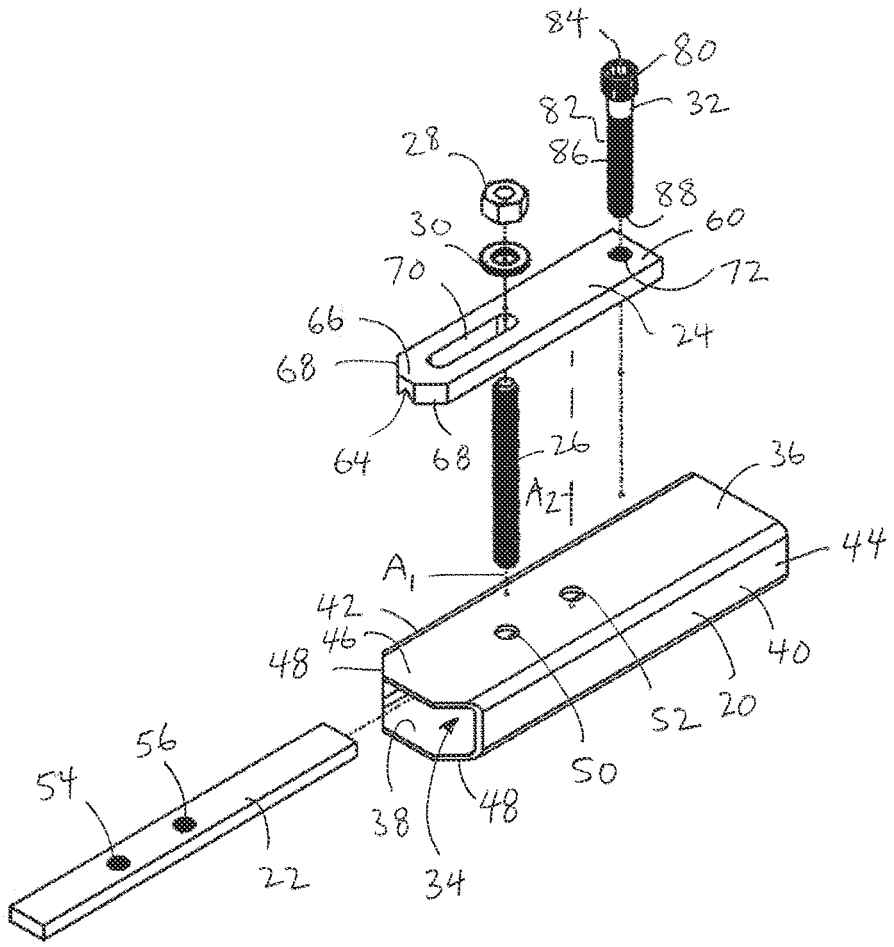
FIG. 2 is an exploded view of the universal clamp assembly, assembled as shown in FIG. 1.
Figure 3:
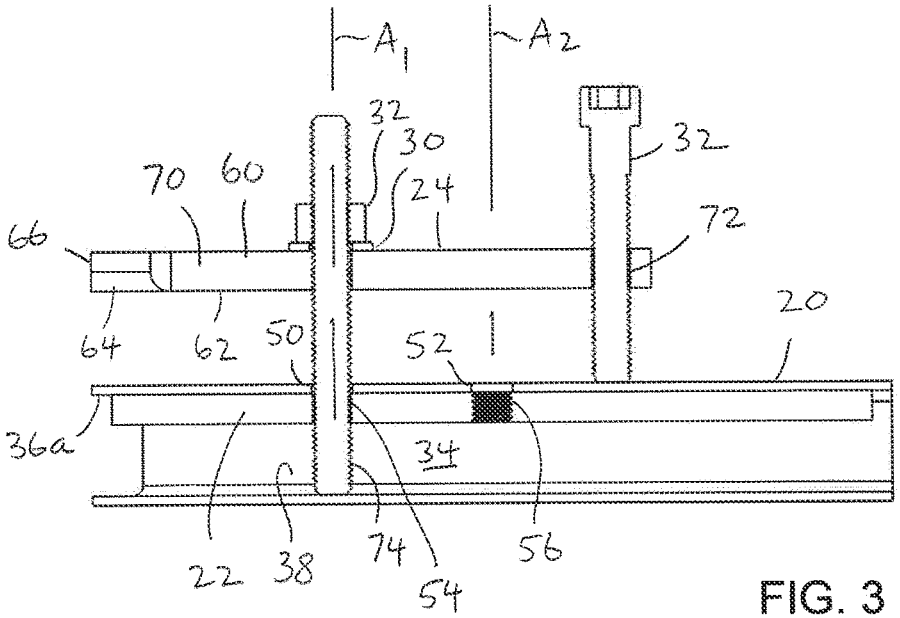
FIG. 3 is a longitudinal section view of the assembly of FIGS. 1 and 2, shown without workpiece.

Referring now to FIGS. 1 through 3, the clamp assembly 10 shown includes the components of an elongate tubular base 20, an optional nut plate 22 integrated with the tubular base, a clamp arm 24 adjustably mounted to the tubular base with a threaded fastener assembly, preferably including a threaded shaft 26, a nut 28, and a washer 30, and an adjustment screw 32 for adjusting the angle of the clamp arm relative to an upper side 36 of the base.

The tubular base 20 defines a longitudinal hollow 34, and in a preferred embodiment has a rectangular cross section thereby defining four sides: upper side 36, lower side 38, and first and second lateral sides 40, 42. Each of the sides 34 has outer and inner surfaces, with the respective outer surface denoted a, and the inner surface denoted b. The base 20 has a proximal end 44 for supporting the clamp assembly 10 in a clamp of a machine and a distal end 46 for supporting the workpiece 12. The distal end 46 may be tapered with angled or rounded corners 48. The base 20 has two longitudinally off set apertures 50, 52 in the upper side 36.

The nut plate 22 is a generally rectangular bar stock inserted into the hollow 34 of the base and integrated with the inside upper side 36*a* of the base, e.g., via welding, brazing, adhesion bonding or other suitable means. The nut plate 22 includes first and second machine-threaded holes 54, 56 that are axially aligned with the apertures 50, 52 in the upper side 36 along first and second axes, $A_1$, $A_2$, respectively. Alternatively, the upper side 36 of the base 20 can be made of sufficiently thick material to support machine threads itself about the periphery of the apertures 50, 52 without addition of the nut plate; in such case, the nut plate is not required as part of the assembly. However, by keeping the wall thickness of the base 20 relatively thin, the weight of the base 20 is reduced for increased portability and maneuverability, and a larger internal volume of the hollow 34 is provided for securing workpieces therein as well, as discussed below.

The clamping arm 24 has an upper surface 60 and a lower surface 62. The lower surface 62 has a longitudinal channel 64 extending from a distal end 66 and proximally back, e.g., to a midportion. The channel 64 is preferably in the form of a V-groove. The distal end 66 of the clamping arm may be tapered with angled or rounded corners 68. The clamping arm includes two openings: an unthreaded elongate slot 70 and a round threaded hole 72. The unthreaded slot 70 of the clamp arm 24 is aligned with the distal vertical axis $A_1$.

A first end 74 of the threaded shaft 26 is inserted through the slot 70 of the clamping arm 24, through the first aperture 50 of the base 20 and is threaded through the distal threaded hole 54 of the nut plate 22 until the first end 74 seats against the lower side of the 38 of the base. The washer 30 and nut 28 are provided onto the second end 76 of the threaded shaft 26. The washer 30 and nut 28 may be separate components, as shown, or integrated as a single and unitary component. For example, the washer 30 may be defined as a lip about the periphery of the nut 28. (As such, reference to the washer and nut individually, here or in the claims, should not be read to require that such components be separable.) Alternatively, in the fastener assembly it is possible that no washer 30 be used, and the clamping arm be secured with the nut only. The clamping arm 24 can be longitudinally displaced on the slot 70, to a furthest extended position in which the threaded shaft 26 contacts the proximal end of the slot 70 and the distal end 66 of the clamping arm 24 is substantially even with the distal end 46 of the base 20 (FIG. 3), and to a retracted position in which the threaded shaft 26 contacts the distal end of the slot 70. The nut can be threaded on the threaded shaft to move the washer against the upper surface of the clamping arm and provide a compression force to prevent additional displacement of the clamping arm on the threaded shaft and relative to the base. This permits application of clamping force to a workpiece located between the clamping arm 24 and the upper side 36 of the base 20.

The adjustment screw 32 includes a head 80 and a shaft 82. The head 80 preferably includes a knurled exterior and a hex head opening 84. The shaft 82 includes machines screw threads 86 and an end 88. The shaft 82 of the adjustment screw 32 is threadedly engaged with the threaded hold 72 of the clamp arm 24 and advanced until the end 88 seats on the outer upper side 36*a* of the base 20. The adjustment screw 32 is rotatably adjustable to cause the end 88 of the screw to be displaced relative to the threaded hole 72 by a distance that maintains the clamp arm 24 in a parallel configuration relative to the base 20, or optionally, in an angle orientation. The end 88 can be seated at any location on an arc defined by rotation of the hole 72 about the first axis $A_1$.

The distal angled corners 48, 68 on the base and clamping arm, respectively, permit working a workpiece at such locations without the clamp assembly 10 interfering with the machine or machine tool.

Figure 4:
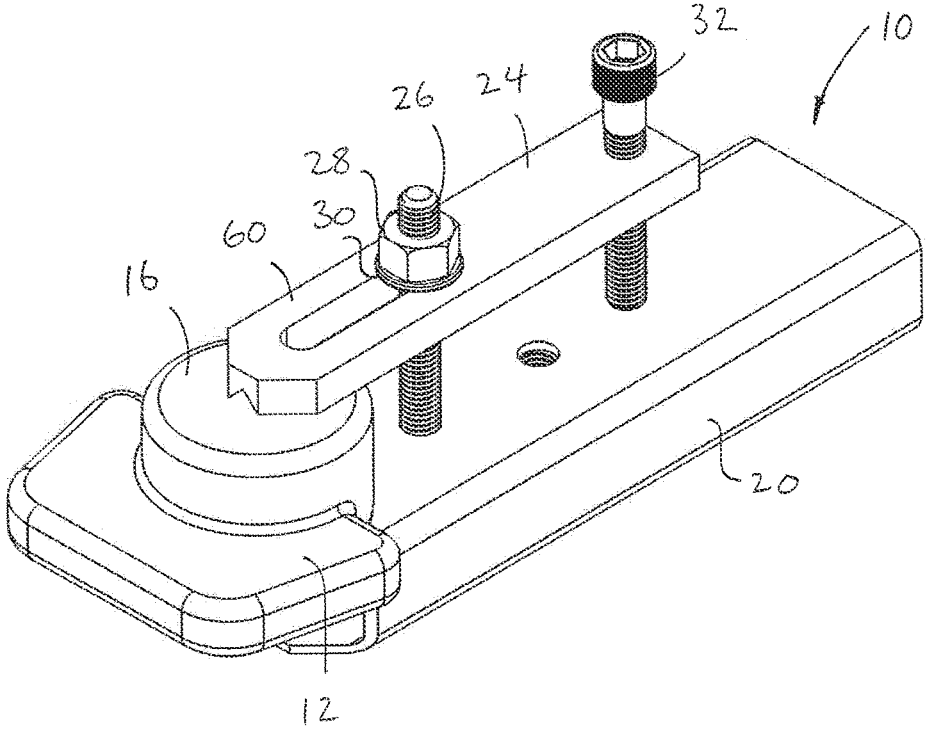
FIG. 4 is a perspective view of the universal clamp assembly according to an embodiment of the invention, in the first configuration, and shown securing a thick portion of the workpiece.

Referring now to FIG. 4, clamping assembly 10 is shown adjusted into a second configuration (of many) to hold a workpiece. The exemplar workpiece 12 is clamped between the base 20 and the clamping arm 24 to hold the thicker cylindrical portion 16 of the workpiece. The adjustment is quick and easy: the nut 28 is unthreaded along the threaded shaft 26 (relative to the position in FIG. 1) and the nut 28 and washer 30 are displaced to allow a sufficient space between the base 20 and the clamping arm 24 to receive the intended portion 16 of the workpiece 12. The clamp arm 24 can be longitudinally displaced relative to the threaded shaft 26 along the slot 70, as necessary. Then the nut 28 is threadedly tightened to force the washer 30 against the upper surface 60 of the clamping arm 24 and thereby stably hold the workpiece.

Figure 5:
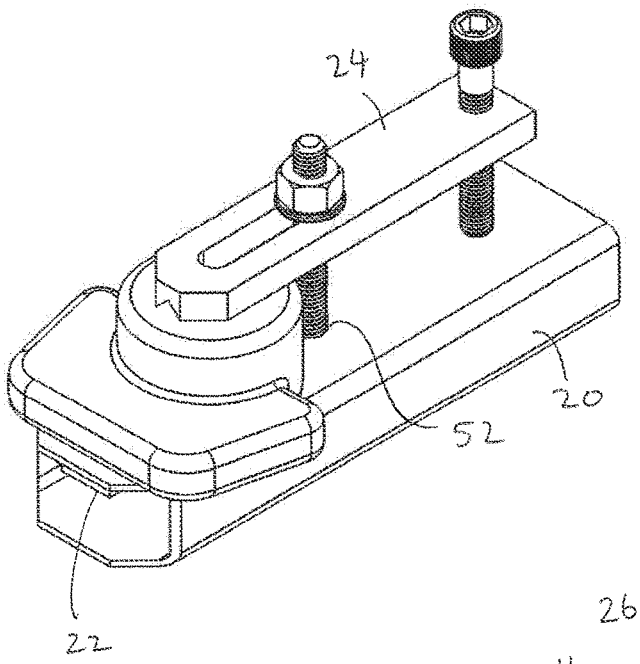
FIG. 5 is a perspective view of the universal clamp assembly according to an embodiment of the invention, in a second configuration, and shown securing a thick portion of the workpiece.

In addition, the threaded shaft 26, and clamp arm 24 supported thereby, can be anchored proximally along the base 20 at the second aperture 52 and threaded into threaded hole of the nut plate 22, as shown in FIG. 5. This accommodates positioning the workpiece further back along the base to accommodate various machining operations as well as larger workpieces.

Figure 6:
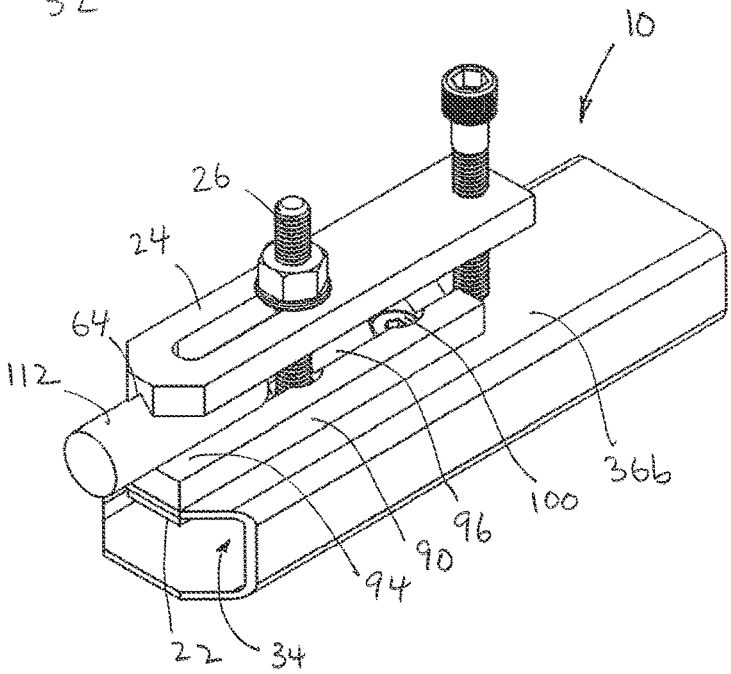
FIG. 6 is a perspective view of a universal clamp assembly according to an embodiment of the invention, in the first configuration and provided with an optional clamping block, shown securing a cylindrical portion of workpiece.
Figure 7:
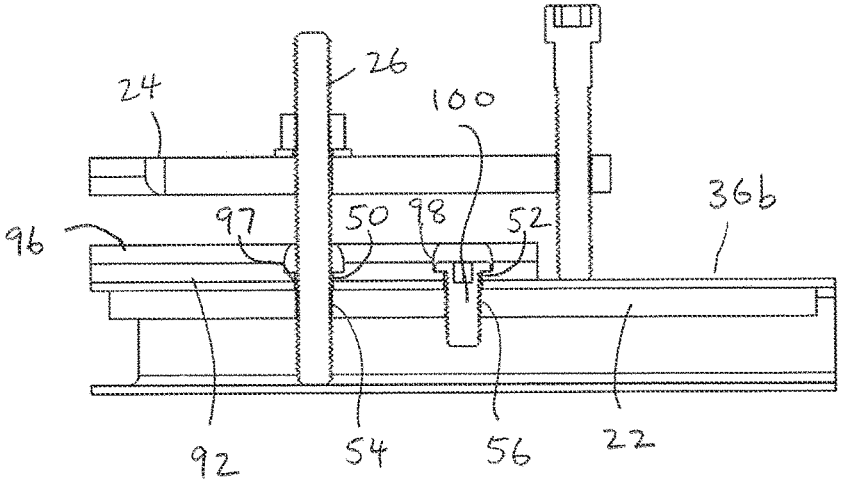
FIG. 7 is a longitudinal section view of the assembly of FIG. 6, shown without the workpiece.

Turning now to FIGS. 6 and 7, in an optional aspect of the clamp assembly 10, a supplementary clamping block 90 can be attached to the outer upper surface 36*b* of the base 20 to facilitate handling and securing of a workpiece having an elongate cylindrical portion. The supplementary clamping block 90 has a first surface 92 which contacts the outer upper surface 36*b* of the base 20, and a second surface 94 provided with a V-groove channel 96 which faces the opposing channel 64 in the clamping arm 24. The clamping block 90 also includes two holes 97, 98 spaced apart the distance between the first and second apertures 50, 52 in the base. The threaded shaft 26 is inserted through the hole 97 as well as first aperture 50 and secured into threaded aperture 54 of nut plate 22 (or integrated threaded first hole of the base), and a set screw 100 is provided and inserted at second aperture 98 of the clamping block, the second hole 52 of the base, and into the corresponding threaded aperture 56 of the nut plate (or integrated threaded second aperture of the base). An elongate portion of a workpiece 112, e.g., cylindrical bar stock, polygonal bar stock, or other material, can be inserted between the clamping arm 24 and the clamping block 90, and the clamping arm 24 can be tightened against the material as described above to secure the material for machining. While the channels 64, 96 on the clamping arm 24 and clamping block 90 facilitate engagement and securing of an elongate portion of a workpiece, it is appreciated that, if necessary, an elongate portion can be secured via the channel 64 in the clamping arm 24 and the upper surface 36*b* of the base 20, even if the clamping block 90 is not utilized or is not provided.

In addition, the clamping arm 24 can be secured with the threaded shaft 26 positioned through the second hole 52 of the base 20, as shown in FIG. 5, even when the supplementary clamping block 90 is used. In such situation, the set screw is inserted through the first hole 50 of the base and into the corresponding threaded aperture of the nut plate 22.

According to another aspect of the system, the supplementary clamping block 90 can be received into the hollow 34 of the base 20. In such manner, the clamping block 90 and be used to secure a workpiece or a portion thereof between the V-groove channel 96 of the clamping block and the nut plate 22 or another interior surface of the base 20.

In all configurations, the proximal end 44 of the base 20 can be secured in standard clamps of numerous machines, including chop saws, band saws, grinders, drill presses, etc., while a workpiece is cut, machined, or otherwise shaped. To facilitate clamping in the standard clamps of such devices, the base 20 is: at least 4 inches in length (between the proximal end 44 and the distal end 46), preferably at least 8 inches in length, and more preferably 8 to 16 inches in length; preferably at least 0.5 inch in height (between the upper surface 36 and lower surface 38), and more preferably 1 to 2 inches in height to provide safety of use and a suitable hollow; and preferably at least 1.5 inches in width (between the lateral sides 40, 42), and more preferably 2 to 4 inches in width for sufficient strength. In one preferred embodiment, the base conforms to the dimensions of a 2×4 common stud, which has actual dimensions of 1.5 inches in height by 3.5 inches in width, but in hollow metal form, with a length of 10-12 inches for handling and clamping and preferably with the defined contours at the distal end. The shape of the clamping assembly is adapted to minimize interference with the machine tool during the machining operation, permitting unfettered approach to the workpiece.

In view of the above, it is appreciated that the clamp assembly permits stably holding a variety of workpieces for shaping processes. The components of the clamp assembly 10 are preferably made from metal such as steel, iron, or other suitable strong and durable materials. For example, the components can be made of wood for use in a wood shop or of high strength polymers.

There have been described and illustrated herein several embodiments of a universal clamping assembly and methods of clamping a workpiece. While embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A clamping system for holding a workpiece, comprising:

a) a base having a hollow at an interior thereof, the base having a first end and a second end, the first end being tapered in width, the base having an upper side and a lower side on an opposite side of the hollow, the upper side having an interior surface and an exterior surface, with a first base aperture extending between the interior surface and the exterior surface;

b) a clamping arm having a first end and a second end, and a clamping surface oriented toward the upper surface of the base, the clamping arm having an elongate throughslot and a threaded hole;

c) a threaded fastener assembly extending through the elongate slot of the clamping arm and into the first base aperture, the clamping arm longitudinally displaceable relative to the base and threaded fastener by the distance of the throughslot, the threaded fastener assembly adapted to a distance between the clamping surface of the clamping arm and the upper side of the base;

d) an adjustment screw inserted through the threaded hole of the clamping arm and seating on the base, the adjustment screw adjustable relative to the threaded hole of the clamping arm to maintain the clamping surface of the clamping arm and the exterior surface of the base in a relative orientation, wherein the workpiece can be clamped between the clamping surface of the clamping arm at the first end of the clamping arm and the exterior surface at the first end of the base, and the clamping assembly with workpiece is portable.

2. The clamping system according to claim 1, wherein:

the first end of the clamping surface includes a V-groove channel along at least a portion of the clamping surface.

3. The clamping system according to claim 2, wherein:
the elongate throughslot coextends with at least a portion of the V-groove channel.

4. The clamping system according to claim 1, further comprising:
a nut plate having a first threaded opening, the nut plate bonded to the interior surface of the upper side of the base such that the first threaded opening is axially aligned with the first base aperture.

5. The clamping system according to claim 1, wherein:
the threaded fastener assembly includes a threaded shaft, a nut and a washer.

6. The clamping system according to claim 1, wherein:
the base includes a second aperture longitudinally displaced relative to the first aperture, and the first and second apertures are provided with threads for engaging the threaded fastener assembly, and
the threaded fastener assembly is threadedly engagable at either of the first and second apertures.

7. The clamping system according to claim 1, further comprising:
a clamping block having a first surface and a second surface, the first surface including a longitudinal V-groove, and a first hole and a second hole extending through the clamping block in the direction from the first surface of the clamping block to the second surface of the clamping block; and
a set screw,
wherein the base includes a second base aperture, and
the set screw inserted through the second hole of the clamping block and into the second base aperture to at least partially secure the clamping block relative to the base, and the threaded fastener assembly extending through the first hole of the clamping block.

8. The clamping system according to claim 1, wherein:
the base having two lateral sides on opposite sides of the hollow,
the base defining a length between the first and second ends, a height between the upper side and the lower side, and a width between the two lateral sides,
the length is at least 4 inches, the height is at least 0.5 inch, and the width is at least 1.5 inches.

9. The clamping system according to claim 8, wherein:
the length is at least 8 inches, the height is at least 1 inch, and the width is at least 2 inches.

10. The clamping system according to claim 8, wherein:
the base consists of a section of a metal 2×4 stud.

11. A clamping system for holding a workpiece, comprising:
a) a base consisting of a portion of a hollow metal 2×4 stud, the base having a first end and a second end, the base having an upper side and a lower side on an opposite side of the hollow, the upper side having an interior surface and an exterior surface, with a first base aperture extending between the interior surface and the exterior surface;
b) a clamping arm having a first end and a second end, and a clamping surface oriented toward the upper surface of the base, the clamping arm having an elongate throughslot and a threaded hole;
c) a threaded fastener assembly extending through the elongate slot of the clamping arm and into the first base aperture, the clamping arm longitudinally displaceable relative to the base and threaded fastener by the distance of the throughslot, the threaded fastener assembly adapted to a distance between the clamping surface of the clamping arm and the upper side of the base;
d) an adjustment screw inserted through the threaded hole of the clamping arm and seating on the base, the adjustment screw adjustable relative to the threaded hole of the clamping arm to maintain the clamping surface of the clamping arm and the exterior surface of the base in a relative orientation,
wherein the workpiece can be clamped between the clamping surface of the clamping arm at the first end of the clamping arm and the exterior surface at the first end of the base, and the clamping assembly with workpiece is portable.

12. The clamping system of claim 11, wherein:
the base has first and second lateral side connecting the upper and lower sides, and the base defines a width between the first and second lateral sides, the width tapering at the first end.

13. The clamping system according to claim 12, further comprising:
a clamping block having a first surface and a second surface, the first surface including a longitudinal V-groove, and a first hole and a second hole extending through the clamping block in the direction from the first surface of the clamping block to the second surface of the clamping block; and
a set screw,
wherein the base includes a second base aperture, and
the set screw inserted through the second hole of the clamping block and into the second base aperture to at least partially secure the clamping block relative to the base, and the threaded fastener assembly extending through the first hole of the clamping block.

14. The clamping system according to claim 13, wherein:
the first end of the clamping arm includes a V-groove channel along at least a portion of the clamping surface.

15. The clamping system according to claim 13, wherein:
the elongate throughslot coextends with at least a portion of the V-groove channel.

16. The clamping system according to claim 12, further comprising:
a nut plate having a first threaded opening, the nut plate bonded to the interior surface of the upper side of the base such that the first threaded opening is axially aligned with the first base aperture.

17. The clamping system according to claim 11, wherein:
the threaded fastener assembly includes a threaded shaft, a nut and a washer.

18. The clamping system according to claim 11, wherein:
the base includes a second aperture longitudinally displaced relative to the first aperture, and the first and second apertures are provided with threads for engaging the threaded fastener assembly, and
the threaded fastener assembly is threadedly engagable at either of the first and second apertures.

19. A clamping system for holding a workpiece, comprising:
a) a base having a first end and a second end, the first end being tapered in width, the base having an upper side and a lower side, and a first base aperture and a second base aperture extending into an interior of the base;
b) a clamping arm having a first end and a second end, and a clamping surface oriented toward the upper surface of the base, the clamping arm having an elongate throughslot and a threaded hole;
c) a threaded fastener assembly extending through the elongate slot of the clamping arm and into one of the first base aperture and the second base aperture, the clamping arm longitudinally displaceable relative to the base and threaded fastener by the distance of the throughslot, the threaded fastener assembly adapted to a distance between the clamping surface of the clamping arm and the upper side of the base;

d) an adjustment screw inserted through the threaded hole of the clamping arm and seating on the base, the adjustment screw adjustable relative to the threaded hole of the clamping arm to maintain the clamping surface of the clamping arm and the exterior surface of the base in a relative orientation, wherein the workpiece can be clamped between the clamping surface of the clamping arm at the first end of the clamping arm and the exterior surface at the first end of the base.

20. The clamping system of claim 19, wherein:

the base is hollow, and the base defines a height extending between the upper and lower surfaces, and a width transverse to the height, and the base is tapered in width at the first end.

* * * * *